US008147017B2

(12) United States Patent
Casoli

(10) Patent No.: US 8,147,017 B2
(45) Date of Patent: Apr. 3, 2012

(54) SYSTEM FOR ANCHORING THE SEAL TO A REFRIGERATOR

(75) Inventor: Fiorenzo Casoli, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 509 days.

(21) Appl. No.: 12/374,969

(22) PCT Filed: Jul. 9, 2007

(86) PCT No.: PCT/EP2007/056937

§ 371 (c)(1),
(2), (4) Date: Jan. 23, 2009

(87) PCT Pub. No.: WO2008/012193

PCT Pub. Date: Jan. 31, 2008

(65) Prior Publication Data

US 2009/0184615 A1 Jul. 23, 2009

(30) Foreign Application Priority Data

Jul. 26, 2006 (IT) ..... VA2006A0048

(51) Int. Cl.
*A47B 96/04* (2006.01)

(52) U.S. Cl. ..... 312/406; 312/406.2

(58) Field of Classification Search ..... 312/405, 312/296, 326–329, 406–407.1, 409, 401; 292/251.5, DIG. 71; 277/644, 630, 637; 49/475.1, 489.1, 478.1
See application file for complete search history.

(56) References Cited

U.S. PATENT DOCUMENTS

| | | | | | |
|---|---|---|---|---|---|
| 2,036,781 | A | * | 4/1936 | Steenstrup | 49/489.1 |
| 2,486,507 | A | * | 11/1949 | Szymczyk | 312/405 |
| 2,723,896 | A | * | 11/1955 | Wurtz | 312/296 |
| 2,938,363 | A | * | 5/1960 | Dickinson et al. | 62/249 |
| 3,077,644 | A | * | 2/1963 | Kesling | 49/366 |
| 3,137,900 | A | * | 6/1964 | Carbary | 49/478.1 |
| 3,378,957 | A | * | 4/1968 | Frehse | 49/478.1 |
| 4,617,759 | A | * | 10/1986 | Pasqualini et al. | 49/478.1 |
| 4,822,117 | A | * | 4/1989 | Boston, Jr. | 312/257.1 |
| 5,588,731 | A | * | 12/1996 | Schmidt et al. | 312/405 |
| 6,266,970 | B1 | * | 7/2001 | Nam et al. | 62/277 |

FOREIGN PATENT DOCUMENTS

| | | | |
|---|---|---|---|
| DE | 2420140 | A1 | 11/1975 |
| EP | 0599161 | | 6/1994 |
| EP | 1267136 | A2 | 12/2002 |
| WO | 0071949 | | 11/2000 |
| WO | 03052334 | A1 | 6/2003 |

OTHER PUBLICATIONS

International Search Report for PCT/EP2007/056937.

* cited by examiner

*Primary Examiner* — Darnell Jayne
*Assistant Examiner* — Andres F Gallego
(74) *Attorney, Agent, or Firm* — Kirk W. Goodwin; McGarry Bair, PC

(57) ABSTRACT

A refrigerator, the construction of which provides for the use of a seal (70) inserted into the structure of the chamber (50) or into the door (60), which minimises the distance (D2) between the door and the structure of the chamber of the refrigerator in the closed position, increasing the thermal tightness of the refrigerator with the door closed and thereby increasing the efficiency of the refrigerator.

16 Claims, 3 Drawing Sheets

SYSTEM FOR ANCHORING THE SEAL TO A REFRIGERATOR

CROSS-REFERENCE TO RELATED APPLICATIONS

This application claims priority on International Application No. PCT/EP2007/056937, filed Jul. 9, 2007, with claims priority on Italian Application No. VA/2006/A/000048, filed Jul. 26, 2006.

The present invention concerns a refrigerator, the construction of which provides for the use of a seal inserted into the structure of the chamber, or into the door, with the aim of ensuring tightness between chamber and door.

There are known refrigerators for which a seal made of elastomeric material, in the form of a bellows or provided with air chambers, is interposed between the door and the structure of the refrigerator in order to improve thermal insulation and to cushion the closing of the door when the latter is closed over the structure of the chamber of the refrigerator.

In known solutions the seal is arranged along the whole perimeter of the structure, usually in a housing made between the inner half-shell and the one outside the structure of the chamber, protruding significantly from the surface on which it is fixed. This arrangement of the seal ensures that the refrigerator is closed however the door is aligned with respect to the structure of the chamber of the refrigerator, even when the hinges of the door are not in perfect alignment. Such a seal can be fixed either to the door of the refrigerator or to the structure of the refrigerator, or to both parts, for example as described in U.S. Pat. No. 6,056,383.

The use of magnets connected to the seal is also known, in order to improve closing further and to avoid using mechanical closing systems—now completely obsolete for safety reasons.

There are also known structural solutions either for the door or for the structure of the chamber of the refrigerator, which result from connecting an outer half-shell to an inner one, using plastic profiles as joints between the parts so as to prevent the expanded heat-insulating material from leaking out when it is injected inside the parts joined during manufacture.

In these solutions the tightness seal is often fixed to the plastic profile or is interposed directly between the two shells, said seal acting as a non-removable joint profile. Also in these cases, as previously, the seal protrudes significantly from the surface to which it is fixed. It will immediately be observed that these types of construction generate major quality problems during the manufacture of the refrigerator. These problems result substantially in the seals being deformed or simply displaced from their original position, as a result of the pressures generated by the solidification of the insulating material inserted between the half-shells, typically polyurethane, which presses against the plastic connecting joints and the deformable seals.

Finally, there are known constructions of refrigerator doors and structures, in which the inner half-shell it is connected directly to the outer one without using any interposed component, for example by means of connection solutions of the tongs type. In these constructions the elements for fixing the seal are defined by the connection of the two half-shells.

Also in this last solution the thermal tightness between the door and the structure of the chamber of the refrigerator in the closed position is ensured by a seal that protrudes substantially from the interface surface of the part to which it is fixed, whether this is the door of the refrigerator or the structure of the chamber. The purpose of such a protrusion is always that of compensating for the dimensional clearance of the door, which, when closing onto the structure of the chamber of the refrigerator, often tends to get out of alignment, encouraging dispersion of heat from the refrigerator.

The aim of the present invention is a solution that improves the structural aspects of the refrigerator, making it possible to minimise the distance between the door and the structure of the chamber of the refrigerator in the closed position, reducing the connection clearance of the parts when the refrigerator is closed and increasing the thermal tightness of the refrigerator with the door closed, thereby increasing the efficiency of the refrigerator.

Other advantages and characteristics of the present invention will become clear from the following detailed description provided by way of non-restrictive example, with reference to the attached drawings in which.

Figure 1:
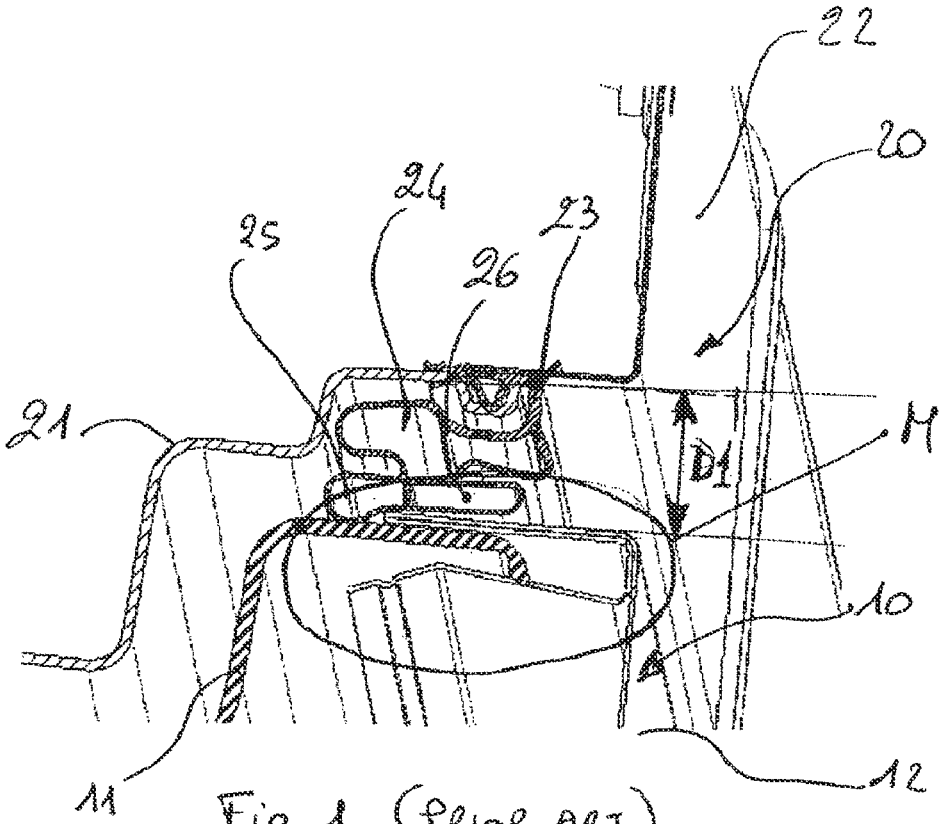
Fig. 1 (Prior Art)
FIG. 1 shows the cross-section of a portion of the door closed onto the structure of the refrigerator to which a seal is fixed, according to a known construction.

With reference to FIG. 1, the typical construction of structure 10 of a known refrigerator is constituted by an inner plastic half-shell 11 (also known as a "liner") that is connected to an outer metal half-shell 12 by means of a spring-type connection M between the parts 11 and 12. The door of the refrigerator 20 is also composed of an inner plastic half-shell 21 connected to an outer metal half-shell 22. A deformable seal 23, provided with air chambers 24 and 25 and with a magnet 26, is held by the two half-shells 21 and 22 connected together. This seal 23 extends, together with its air chambers 24 and 25, outside the door in order to close off the spaces between the structure 10 and the door 20 when the refrigerator is closed, preventing dispersion of heat from the refrigerator. A substantial distance D1 can be noted between the outer perimeter of the structure of the refrigerator 10 and the door 20 when the door is closed onto the structure. This distance is caused by the volume of the seal 23, interposed between the parts 10, 20.

Inside either the thickness of the door 20 or the structure 10 of the refrigerator, insulating material (not illustrated) is inserted.

Figure 2:
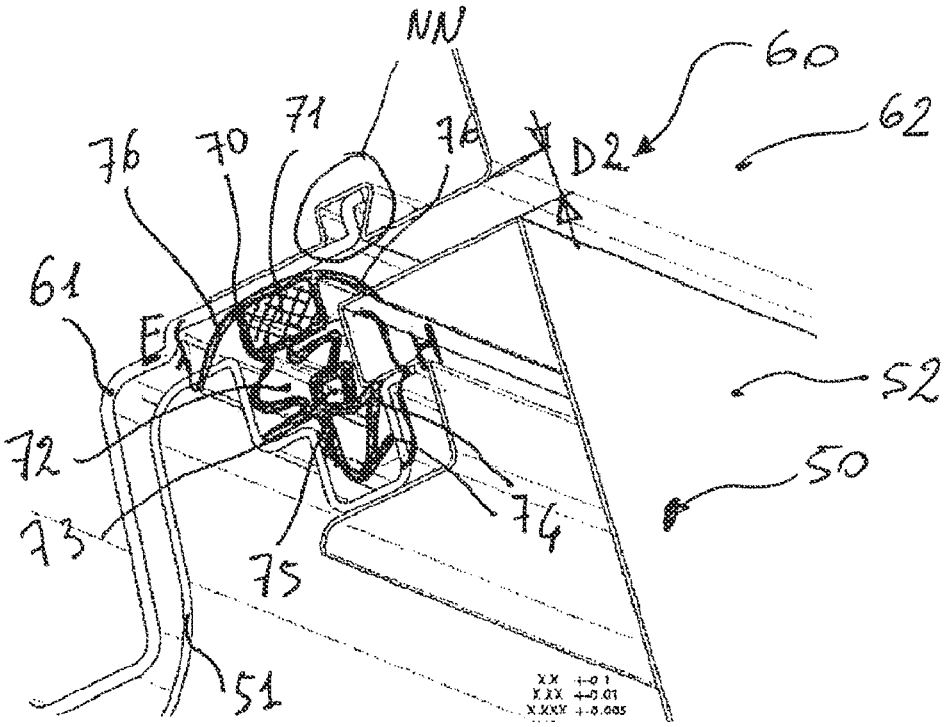
FIG. 2 illustrates the cross-section of a portion of the door closed onto the structure of the refrigerator to which the seal is fixed, according to the present invention.
Figure 3:
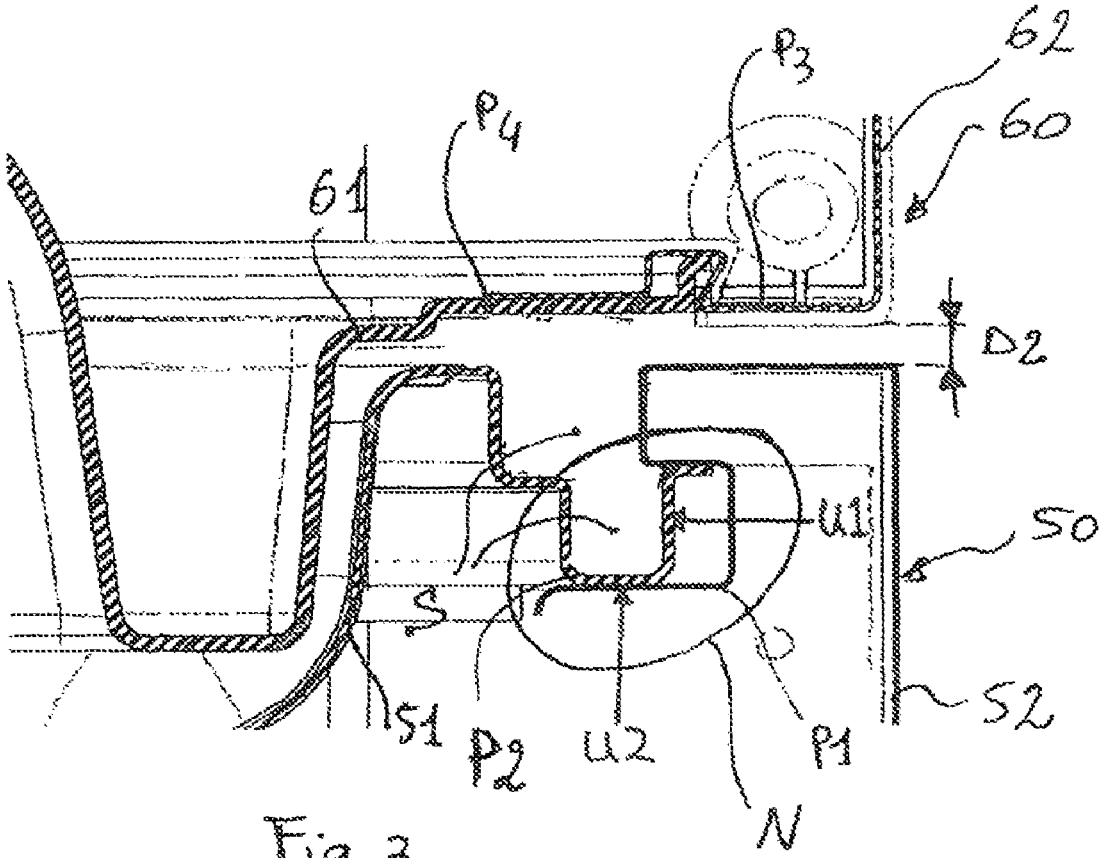
FIG. 3 illustrates a detail of the cross-section illustrated in FIG. 2, from which the seal has been omitted.
Figure 4:
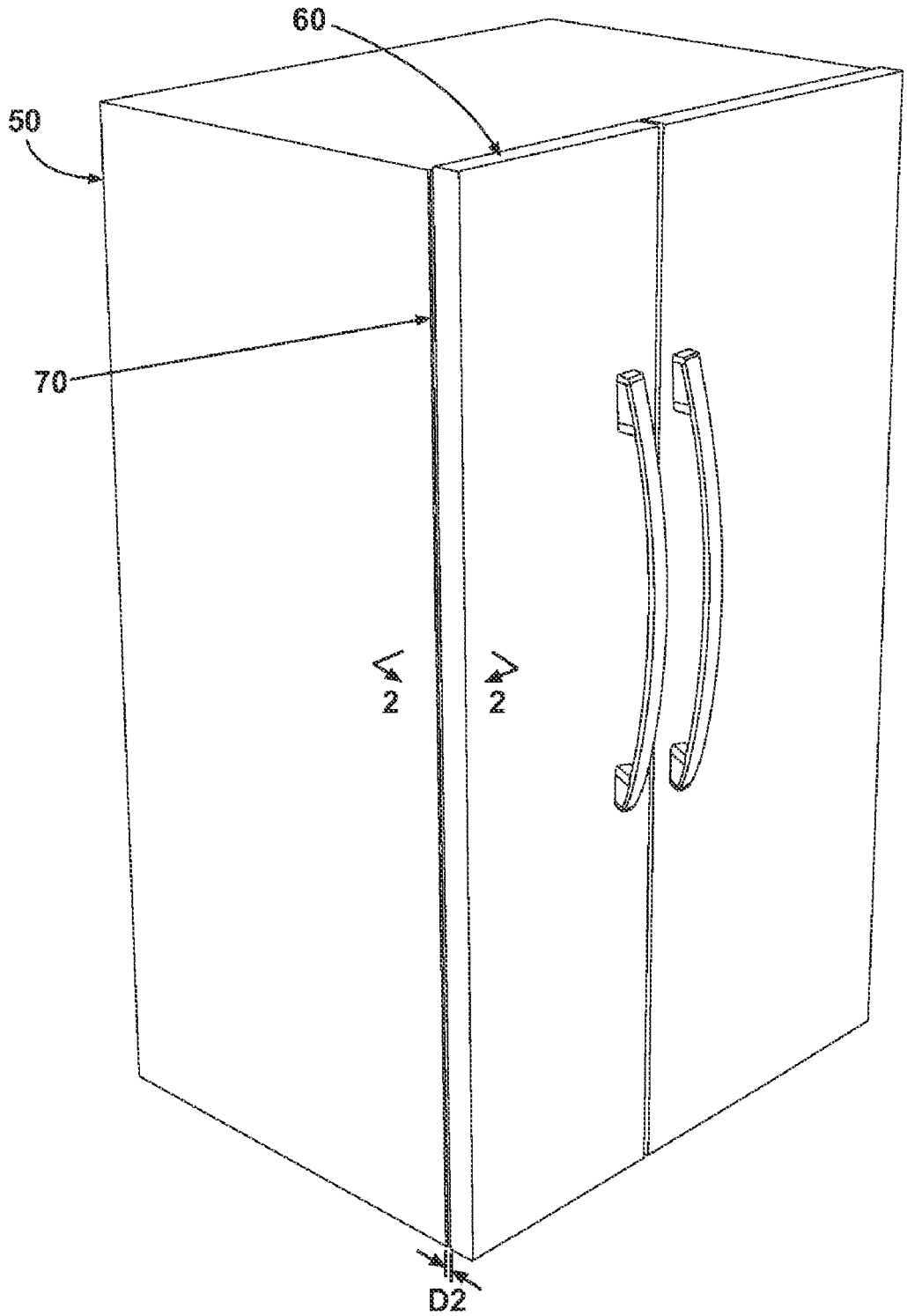
FIG. 4 shows a perspective view of the refrigerator from which the cross sectional view 2-2 illustrated in FIG. 2 and FIG. 3 was taken.

With reference to FIGS. 2-4, a refrigerator according to the present invention is similarly constituted by a structure 50, composed of an inner plastic half-shell 51 and an outer metal half-shell 52, joined together along the outer edges P1 and P2 with a connection having elastic deformation N. More specifically, as depicted in FIG. 3, outer edge P2 of inner plastic half-shell 51 includes an elastic portion constituted by an substantially u-shaped portion U1 having an arm not labeled extending substantially perpendicular therefrom, wherein the substantially u-shaped portion U1 defines part of a labyrinth-like seal seat S. Similarly, the outer edge P1 of the metal half-shell 52 includes an elastic portion constituted by a substantially u-shaped portion U2 into which substantially u-shaped portion U1 is fit. Thus, it can be understood that the outer and inner half-shells 50 and 51 are joined together by means of a spring-type connection between the respective outer portions. The refrigerator comprises a door 60, also produced by joining an inner plastic half-shell 61 to an outer metal half-shell 62, also joined to a connection having elastic deformation NN along the outer edges P3 and P4. The inner half-shells 51 and 61 of the structure and of the door respectively are made from thermoformed plastic material. Inside the thickness of the door 60 and the structure 50 of the refrigerator, insulating material is inserted.

In different embodiments the half-shells, 51, 52 and 61, 62 respectively are connected so that the respective outer edges P1, P2 and P3, P4 correspond, using connection methods other than the elastic ones described above, for example methods that use hinges, angle brackets, fixing with screws or rivets, or by means of thermowelding. According to the present invention, from the connection between the outer 50 and inner 51 half-shell of the structure 10 of the refrigerator, the labyrinth like seat S is made, to the inside of which is fixed, and nearly completely housed, a seal 70 provided with a magnet 71 and air chambers 72 and 73. The seal 70 is provided with appendages having lips 74 and 75 so that it can be anchored stably in the seat 8, and is arranged along the whole front perimeter of the structure 50 of the refrigerator, and with an end part 76 having a semicircular section. In an alternative embodiment (not graphically described), the seal has an end portion provided with a membrane shaped so as to prevent the penetration of dirt into the seat S.

According to the present invention, from the connection between the outer 50 and inner 51 half-shell of the structure 10 of the refrigerator, a labyrinth-like seat S is made, to the inside of which is fixed, and nearly completely housed, a seal 70 provided with a magnet 71 and air chambers 72 and 73. The seal 70 is provided with appendages having lips 74 and 75 so that it can be anchored stably in the seat S, and is arranged along the whole front perimeter of the structure 50 of the refrigerator, and with an end part 76 having a semicircular section. In an alternative embodiment (not graphically described), the seal has an end portion provided with a membrane shaped so as to prevent the penetration of dirt into the seat S.

According to the present invention, the greater portion H of the volume of the seal 70 is housed inside the seat S, while one of its ends E protrudes from the same seat and bears against the door 60. Since the volume of the end E of the seal 70 protrudes outside the seat S to a small extent compared with the greater portion I of its volume, the distance D2 between the closed door 60 and the structure of the refrigerator 50 is minimised and is less than known solutions e.g. according to FIG. 1, giving better alignment of said parts 50 and 60, as well as better thermal insulation.

The cushioning functions of the seal 70, through the deformation of Its air chambers 72 and 73, is maintained because the seal 70 is deformed, in the greater part H of its volume, inside the seat S.

In a variant of the present invention the magnet 71 is eliminated, as a consequence of the reduced connection clearance between the structure 50 and the door 60 and by virtue of the better thermal tightness achieved, the door being kept closed by appropriate elastic means, e.g. by hinges. In a second variant of the present invention the seat S is produced between the half-shells 61 62 of the door of the refrigerator, rather than between the half-shells of the structure 51 and 52, and the seal 71 is inserted there. In another variant of the invention the seat S is made either on the structure 50 or on the door 60 of the refrigerator, so as to produce a refrigerator with a double seal, with a distance between door and structure that is minimised.

Finally, the seal 70 used in the refrigerator according to the present invention is easy to install and remove, giving greater flexibility in the manufacturing assembly process and making it easier to clean said refrigerator while in use.

As described above a refrigerator is produced in which the distance D2 between the structure of the refrigerator 50 and the door 60, when the door is closed, has been reduced, and where the connection clearance between the parts 50 and 60 that compose the refrigerator cabinet has been reduced.

By virtue of the reduction in the distance D2, dispersion of heat from the refrigerator is also reduced, both convective dispersion, due to badly positioned or deformed seals, and conductive dispersion due to any thermal bridges that might be created by the misaligned parts. In this respect the refrigerator according to the present invention has better efficiency of energy consumption, compared with a refrigerator constructed according to techniques known heretofore.

Finally, by virtue of the reduced connection clearance, an aesthetic improvement of the product has also been produced, to be seen as an improvement in the alignment between the unit and its door, which can be achieved thanks to the reduction in connection clearance.

The invention claimed is:

1. A refrigerator comprising:

a door comprising an outer half-shell, an inner half-shell and an insulating material;

a refrigerator chamber structure comprising an insulating material, an outer half-shell having an outer edge portion including a substantially u-shaped elastic portion and an inner half-shell having an outer edge portion including a substantially u-shaped portion, said outer and inner half-shells of the refrigerator chamber structure being connected together so that the u-shaped portion is fit within the u-shaped elastic portion to join the outer and inner half-shells of the refrigerator chamber structure to one another;

a seat for a seal defined, in part, by the u-shaped portion;

a seal made of elastomeric material;

wherein most of the volume of the seal is inserted into said seat to create a minimal distance between the refrigerator chamber structure and the door.

2. The refrigerator according to claim 1, wherein the inner half-shell of the refrigerator chamber structure is made of thermoformed plastic material.

3. The refrigerator according to claim 1, wherein the most of the volume of the seal is configured to deform inside the seat when compressed.

4. The refrigerator according to claim 1, wherein the outer and inner half-shells of the refrigerator chamber structure are joined together by means of a spring connection between the respective outer edge portions.

5. The refrigerator according to claim 1, wherein the seal is removable.

6. The refrigerator according to claim 1, wherein the seal is provided with first and second air chambers housed within the seat.

7. The refrigerator according to claim 6, wherein the seal is deformable.

8. The refrigerator according to claim 7, wherein the seal has an end portion with a semicircular cross-section.

9. The refrigerator according to claim 8, wherein the seal has an end portion shaped so as to prevent the penetration of dirt into the seat.

10. The refrigerator according to claim 9, wherein the seal is provided with a magnet.

11. The refrigerator according to claim 1, wherein the seal is deformable.

12. The refrigerator according to claim 1, wherein the seal has an end portion with a semicircular cross-section.

13. The refrigerator according to claim 1, wherein the seal has an end portion shaped so as to prevent the penetration of dirt into the seat.

14. The refrigerator according to claim 1, wherein the seal is provided with a magnet.

15. The refrigerator according to claim 1, wherein the seal includes lips extending from a bottom portion of the seal which anchor the seal within the seat.

16. The refrigerator according to claim 1, wherein the seat includes a labyrinth structure.

* * * * *